United States Patent [19]

Donabedian

[11] 4,215,488

[45] Aug. 5, 1980

[54] TRAY FOR THE FIELD DRYING OF FRUIT

[76] Inventor: Paul Donabedian, P.O. Box 150, Selma, Calif. 93226

[21] Appl. No.: 1,703

[22] Filed: Jan. 8, 1979

[51] Int. Cl.[2] ..... F26B 25/18

[52] U.S. Cl. ..... 34/238; 34/93; 108/24; 428/182; 428/183; 428/192

[58] Field of Search ..... 34/91, 93, 237, 238; 428/182, 183, 186, 192; 108/24, 90; 206/564

[56] References Cited

U.S. PATENT DOCUMENTS

| | | | |
|---|---|---|---|
| 950,785 | 3/1910 | Pene | 229/90 |
| 1,414,649 | 5/1922 | Jones | 34/238 X |
| 3,097,077 | 7/1963 | Melikian | 34/237 X |
| 3,589,511 | 6/1971 | Britt | 206/564 X |
| 3,765,329 | 10/1973 | Kirkpatrick et al. | 428/192 X |
| 3,934,789 | 1/1976 | Allman et al. | 34/238 X |

FOREIGN PATENT DOCUMENTS

| | | | |
|---|---|---|---|
| 514076 | 12/1930 | Fed. Rep. of Germany | 34/237 |

*Primary Examiner*—Edward G. Favors
*Assistant Examiner*—Harold Joyce
*Attorney, Agent, or Firm*—Huebner & Worrel

[57] ABSTRACT

A tray for the field drying of fruit adapted to be rolled about the fruit during the curing thereof consisting of a flexible rectangular sheet of plastic material provided with longitudinally extending corrugations so that the sheet has greater flexibility transversely than longitudinally, the sheet having perforations in the valleys of the corrugations for drainage of rain water when the sheet is disposed flatly on the ground, tabs disposed to cover the perforations which are inverted when the tray is rolled about the fruit, and a hooked longitudinal edge adapted releasably to engage the opposite longitudinal edge when the tray is in the rolled condition.

11 Claims, 5 Drawing Figures

TRAY FOR THE FIELD DRYING OF FRUIT

BACKGROUND OF THE INVENTION

1. Field of the Invention

The present invention relates to a tray for the field drying of fruit, such as grapes to form raisins, and more particularly for such a tray adapted to minimize spoilage of the fruit when rain occurs during drying 2. Description of the Prior Art It is well known to produce raisins by drying grapes in the field with solar radiation. The conventional method of producing raisins in this manner involves placing trays formed by paper sheets on the earth surface in a vineyard, picking grapes from the vineyard, and disposed the grapes on the trays for exposure to solar radiation for a period of time, rolling each tray about the dried grapes thereon for curing, and then emptying the resulting raisins from the trays for removal from the vineyard, cleaning and packing. Although the paper trays are only used for a few weeks, they are not reusable, new trays being used for each annual harvest.

The occurrence of rain while the grapes are disposed for exposure to solar radiation often causes financial disaster for the raisin producer because of spoilage of the fruit due to dampness resulting from the rain. Under these conditions, the grapes fail to dry and, therefore, mildew and/or decay. The dampness can, of course, be due to rain water standing on the trays with the fruit. However, the dampness can also be due to absorption from the ground of rain water which has soaked therein during a previous rain.

It is customary to terrace or incline the ground surface in the vineyard on which the trays are rested sloped to the South so that rain water will tend to run from the trays and so the fruit on the trays will receive maximum solar radiation. The ground surface cannot, however, in practice be inclined sufficiently to remove all rain water on the trays. As a result, perforated trays have been used to allow rain water to drain into the ground surface. However, they do not solve the problem. When rain water is permitted to pass through the trays, it soaks into the ground where it fails to evaporate because of the overlying tray thus fostering decay and mildew. Whether the trays are perforate or imperforate, they are flexible and fit into any depressions in the ground surface, forming pockets in which water can stand. This too is conducive to spoilage. Further, if the trays are perforated for drainage, the perforations become disposed above the fruit when the tray is "rolled" and allow rain water to run directly onto the grapes.

PRIOR ART STATEMENT

Characterizing the closest prior art of which the Applicant is aware and in compliance with 37 C.F.R. 1.97 and 1.98, attention is invited to the following patents:

| | | |
|---|---|---|
| 635,423 | Chase | Oct. 24, 1899 |
| 1,073,151 | Matthew | Sept. 16, 1913 |
| 3,247,602 | Hamilton et al | Apr. 26, 1966 |
| 3,458,168 | White | July 29, 1969 |

These patents are believed relevant in that they disclose the concept of a grooved drying rack or tray, having perforations in the bottom of the grooves. However, none of these patents disclose the concept of such a device which can be rolled about material being dried thereon. These patents do not, therefore, disclose such a device which is more flexible in one direction than another, which has engageable opposite edges to retain it in a rolled condition, or which includes elements for closing perforations which are inverted when the device is in a rolled condition.

OBJECTS AND SUMMARY OF THE INVENTION

It is, therefore, an object of the present invention to provide an improved tray for the field drying of fruit.

Another object is to provide such a tray through which rain water drains freely from the fruit without being reabsorbed from the resulting moist ground surface.

Another object is to provide such a tray having perforations which are configured to allow rain water to drain from the tray when the perforations are disposed below the fruit.

Another object is to provide such a tray in which perforations utilized for drainage when the tray is in a flat condition are covered to prevent entrance of rain water when the perforations are inverted upon rolling the tray to serve as vents to enhance the drying of the fruit.

Another object is to provide such a tray which is, in general, adapted to conventional methods of field drying of fruit, and, specifically, which can be rolled to enclose fruit disposed thereon for curing and/or weather protection.

Another object is to provide such a tray which is relatively flexible in one direction to allow rolling and is less flexible in another direction so that the tray does not retain water by conforming to depressions in the ground surface on which the tray is rested. Another object is to provide such a tray which minimizes the labor required to roll the tray with the fruit thereon and which conveniently retains itself in the rolled condition.

Another object is to provide such a tray which can be reused and is adapted for convenient and compact storage for such reuse.

Another object is to provide such a tray which reduces the inclination required when terracing a vineyard for the production of dried fruit therein by solar radiation.

An additional object is to provide a tray for the field drying of fruit which is economical, durable, and fully effective in performing its intended function.

DESCRIPTION OF THE PREFERRED EMBODIMENT

Figure 1:
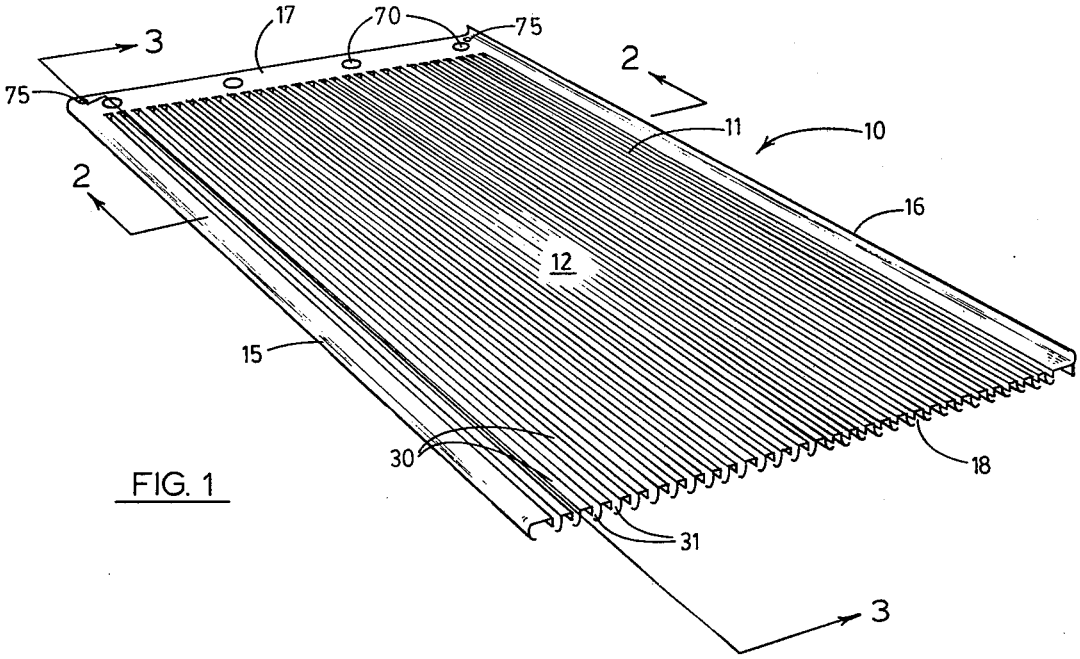
FIG. 1 is a perspective view of a tray for the field drying of fruit embodying the principles of the present invention showing the tray in planar condition.

Referring in greater detail to the drawing, a tray 10 embodies the principles of the present invention. The tray is unitary and is formed of a substantially rectangular, planar sheet 11 of plastic material. The sheet is relatively thin so as to be flexible. However, it is somewhat resilient and is sufficiently rigid so as to retain its general shape for purposes subsequently to be described. The tray can be formed in any suitable manner as by molding, stamping, or casting from a suitable plastic material such as vinyl, cellulose acetate, acetate-butyrate, polyester, polyethylene or the like. The material, preferably, is black or otherwise dark in color so as to absorb solar radiation and be heated thereby to facilitate drying of fruit received on the tray.

Figure 2:
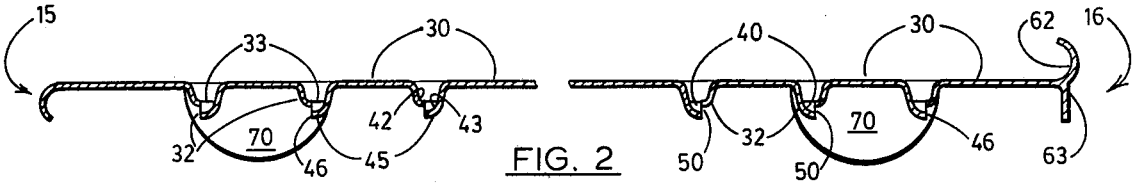
FIG. 2 is a somewhat enlarged transverse section taken on line 2—2 of FIG. 1 which is foreshortened for illustrative convenience.
Figure 3:
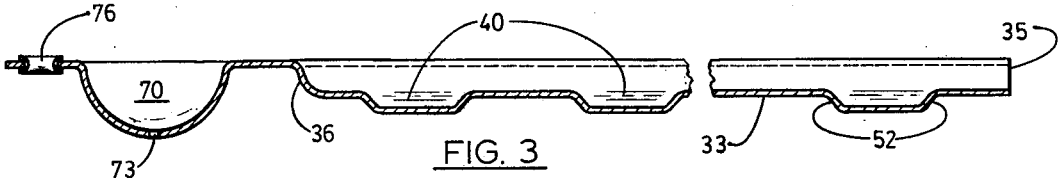
FIG. 3 is a longitudinal section taken on line 3—3 of FIG. 1 which is also foreshortened for illustrative convenience.

The tray 10 has an unrolled condition, depicted in FIGS. 1, 2, and 3, in which the sheet 11 is disposed flatly on the ground which, as conventional, may be sloped preferably to the South. For convenience, the structure of the tray is described with the tray disposed in this unrolled or planar condition.

The sheet 11 has a rectangular, elongated central portion 12. The sheet has a pair of transversely opposite longitudinal edges 15 and 16. One of these edges is downwardly extended from the central portion and is depicted at the left-hand side of FIG. 3. This edge 15 is referred to hereafter as the first longitudinal edge. The opposite longitudinal edge 16 extends upwardly and downwardly from the central portion. The tray, typically, has an upper transverse edge 17 and located toward the upper portion of FIG. 1, elevated somewhat above the other transverse edge 18.

The central portion 12 of the sheet 11 includes a plurality of substantially identical hills alternating with upwardly open, substantially identical valleys 31 so that the tray 10 is corrugated. The hills and valleys extend in substantially parallel relation and are extended longitudinally of the sheet. The valleys are substantially equally spaced transversely of the sheet. The hills are substantially coplanar thereby defining the plane of the sheet. The valleys extend downwardly from this plane to individual, upwardly disposed concave floors 33. The corrugations are substantially coextensive and extend between the transverse edges 17 and 18 of the sheet. Since the valleys extend longitudinally of the sheet, they are conducive to its transverse flexibility and are resistive to its longitudinal flexibility. That is, the sheet is relatively easier to bend along a line extending longitudinally along it than along a line extending transversely across it.

Each valley has a pair of opposite longitudinal ends 35 and 36 best shown in FIGS. 1 and 3. The ends 35 are open longitudinally at the lower transverse edge 18 of the sheet 11. The other ends 36 are closed adjacent to the upper edge 17 of the sheet.

Figure 4:
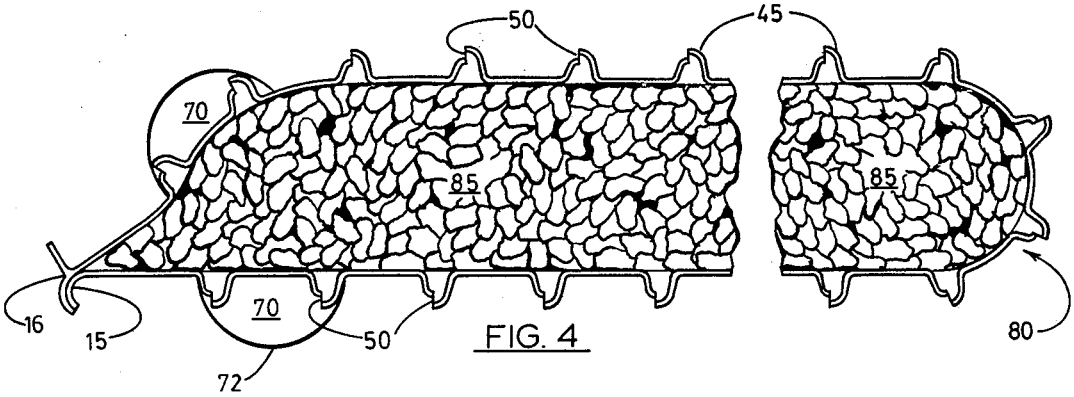
FIG. 4 is a transverse section of the tray enclosing fruit in a rolled condition with portions removed for illustrative convenience.

The floor 33 of each valley 31 is provided with a plurality of perforations 40, best shown in FIGS. 1, 2 and 3, which open downwardly through the floor. The perforations are substantially equally spaced along the floor. Each perforation is of elongated, rectangular shape and is longitudinally aligned with its respective valley. Each perforation has a longitudinal side 42 disposed toward the edge 15 of the sheet and an opposite longitudinal side 43 disposed toward the edge 16 of the sheet. Each of the perforations is provided with a generally rectangular tab 45, best shown in FIGS. 2 and 3, extending downwardly from one of said edges and curved toward the other of said edges to a distal end 46. As shown in FIG. 2, the distal end extends parallel to said other edge of the perforation and is spaced somewhat downwardly therefrom. Said end and said edge define an opening 50 therebetween which faces transversely of the sheet. The tab is formed unitarily from the sheet and has a pair of opposite closed longitudinal ends 52. The tab thus has a hood-like configuration when viewed toward said opening as in FIG. 3. Each tab, therefore, extends in screening or covering relation to its respective perforation and prevents access vertically downwardly thereto when the sheet, or a portion thereof, is inverted so that the floor is upwardly disposed from the plane of the sheet as shown in FIG. 4.

It will be noted that, as shown in FIG. 2, the tabs 45 disposed on opposite lateral sides of the sheet 11 preferably face in opposite directions. As a result, the openings 50 in one of said lateral sides face transversely away from the openings in the other of said sides when the tray is in the unrolled condition.

The first longitudinal edge 15 of the sheet 11 extends downwardly from the plane of the sheet as previously mentioned. This edge is curved toward the central portion 12 of the sheet in a return bent configuration. This edge, therefore, has a convex surface 60 disposed away from the central portion. This surface extends downwardly from said plane a distance approximately equal to the distance the floors 33 of the valleys 31 are disposed below said plane. The second longitudinal edge 16 of the sheet extends upwardly from its plane defining a hook 62. This edge also extends downwardly from said plane defining a leg 63. The hook and the leg extend substantially the same vertical distance from said plane but in opposite directions. This distance is equal to the distance the surface 60 of the first edge 15 extends vertically from said plane. The leg is substantially planar and extends substantially vertically from said plane. The hook is curved toward the central portion of the sheet in a return bent configuration so that the second edge has a concave surface 65 disposed toward the center of the sheet. The hook is configured so that this concave surface, when inverted, substantially conforms to said convex surface.

The tray 10 is provided with a plurality of substantially identical projections 70, best shown in FIGS. 1 and 2, extended downwardly from the plane of the sheet 11 to a tip 72. The projections are spaced along a row extending transversely of the sheet between its upper transverse edge 17 and the closed ends 36 of the valleys 31. Each projection is upwardly open and has an upwardly concave hemispherical configuration. The radius of each projection is substantially longer than the distance the floors 33 of the valleys 31 are disposed below the plane of the sheet. The tips of the projections, therefore, are disposed downwardly from the floors. The tip of each projection is provided with a circular perforation 73 which extends through the sheet.

The tray 10 has a pair of substantially identical storage openings 75, best shown in FIGS. 1 and 3, extending through the sheet 11 adjacent to the pair of its corners which are disposed at the opposite ends of the upper transverse edge 17. These openings are circular and are individually reinforced by a pair of metal grommets 76.

OPERATION

The operation of the described embodiment of the present invention is believed to be clearly apparent and is briefly described at this point.

Initially, the tray 10 is rested on the ground in the unrolled condition as shown in FIGS. 1, 2, and 3. The tray engages the ground at the tips 72 of the hemispherical projections 70 and at the open ends 35 of the valleys downwardly of their respective floors 33. Since the tips extend a greater distance downwardly from the plane of the sheet 11 than said ends, the sheet 11 slopes downwardly toward said ends. Such slope can also be achieved by placing the tray on a sloped terrace formed on the ground. Typically, the surface of the ground in a vineyard has depressions or pockets substantially smaller in extent than the tray. However, individual hills and valleys remain substantially flat as depicted in FIG. 3, due to their relatively limited longitudinal flexibility. The corrugations thus tend to bridge such depressions longitudinally of the sheet rather than sagging into the depressions.

When the tray 10 is in the unrolled condition, the second longitudinal edge 16 of the sheet 11 is supported on the ground by the downwardly extended leg 63. The downwardly extended first longitudinal edge 15 serves as a leg to support the tray on the ground in both the unrolled and the rolled condition as can be visualized from FIGS. 2 and 4.

When the tray 10 is disposed in the unrolled condition, fruit to be dried is placed on the tray for drying by subjection to solar radiation. The fruit, typically bunches of grapes, rests on the hills 30. The valleys 31 are, therefore, relatively unobstructed. Rain water falling on the fruit and the tray while the fruit is drying tends to run longitudinally of the tray toward its lower edge 18 due to the inclination created by the projections 70. Most of said rain water drains immediately from the fruit into the valleys and is gravitationally conveyed along the valleys toward their open ends 35 to the next perforation 40 or out of the open ends and escapes from the tray. Since the valleys extend linearly, rather than conforming to depressions in the ground, there are few or no corresponding depressions in the tray to hold the rain water. Since the rain water does not stand on the tray, the fruit soon becomes dry when the rain ceases. When the ground remains soaked after rain has fallen, dampness from the ground does not directly contact the fruit which is supported above the valleys 31 by the hills 30 of the corrugations.

Rain water entering the projections 70 drains gravitationally through their perforations 73. The tray 10 of the present invention results in rapid and efficient drying of fruit by solar radiation despite rainfall during the drying period because the valleys 30 provide drainage channels and impart longitudinal rigidity. However, the cooperation of the valleys, which collect rain water so as not to contact the fruit, with the perforations 40 results in even more rapid and efficient drying under rainy conditions.

When the fruit has been exposed directly to solar radiation for a sufficient time, the tray 10 is folded transversely about the fruit into a roll indicated by the numeral 80 in FIG. 4. In the production of raisins from grapes, the resulting closed disposition of the tray and fruit is utilized to "cure" the fruit. This disposition also serves to protect the fruit from the weather during rainy condition. In the rolled condition the sheet 11 is folded approximately along its transverse midline so that one side of the sheet which is disposed toward its second edge 16 is inverted. In the rolled condition this edge is juxtapositioned to the first edge 15 and disposed slightly to the left thereof as viewed in FIGS. 4 and 5. The fruit, as indicated by the numeral 85, is thereby encapsulated within the tray with one side of the tray disposed in weather protecting relation over the fruit. The other of said sides, that disposed toward said first edge, remains in substantially the same position relative to the ground and to the fruit as in the unrolled condition. Bending of the tray 10 into the rolled condition is, of course, greatly facilitated by its relatively greater transverse flexibility which is substantially the same as that of a planar layer of the material from which the sheet is formed.

Figure 5:
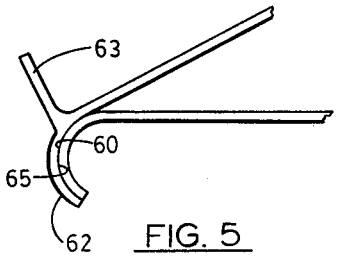
FIG. 5 is a further enlarged fragmentary transverse section of the tray in a rolled condition showing latch means for retaining the tray in said condition.

The tray 10 is releasably retained in the rolled condition by engagement of its longitudinal edges 15 and 16 at their respective conforming surfaces 60 and 65 as best shown in FIG. 5. Since the sheet 11 is formed from somewhat resilient material, the first edge 15 and the hook 62 can be bent apart by the fingers as they are moved into their relative positions shown in FIG. 5. When the sheet is disposed substantially as in the rolled condition, said edge and hook are released by the fingers and are resiliently urged into hooking relation to releasably latch the tray in the rolled condition. Due to this convenient method of retaining the tray in the rolled condition and to its relatively great transverse flexibility, relatively little time and effort are required to roll the tray about the fruit and secure it in the rolled condition. Unrolling of the tray to remove the fruit for packing when it is dried and cured is accomplished with equal facility simply by bending the hook to unlatch it from the first edge. Alternatively, the tray can simply be tipped longitudinally and the raisins poured from it.

It should be noted that a tray for drying fruit can be configured similarly to the tray 10 except that the downwardly extended first edge 15 and the leg 63 are omitted. However, a hook is provided similar to the hook 62. Such a tray is maintained in a rolled condition in substantially the same manner as the tray 10 since the hook can releasably engage the side of the sheet opposite to the side from which the hook extends.

As shown in FIG. 4, the tabs 45 on the side which is upwardly disposed in the rolled condition extend in covering relation to their respective perforations. As a result, rain water which falls onto the tray 10 does not have access to the fruit downwardly through said perforations. The tray 10 thus keeps fruit 85 rolled therein dry even though the perforations 40 are spaced uniformly over the tray to provide effective drainage in the unrolled condition. Also, it should be noted that when the tray is rolled, the perforations in the inverted portions of the tray serve as vents significantly enhancing the drying effect achieved. The other of the sides is downwardly disposed in both the rolled and in the unrolled condition. The valleys 31 and perforations of this section continue to function as in the manner described in connection with the unrolled condition so as to drain from the fruit any moisture which was retained thereon when the tray was rolled.

After the processing of fruit with the trays 10 is complete, the fruit is removed from the trays. The trays cannot be left in the field until the next harvest because of agricultural operations which involve working the ground. However, the trays, being constructed of plastic material, are relatively sturdy and, unlike conventional paper trays, can be reused. It is, therefore, desirable to store the trays until the next harvest. The trays, can, of course, be stacked or disposed in any convenient manner for storage. However, it is preferable to store the trays by hanging a plurality of them in nested relation from spikes or rock, now shown, inserted through the storage openings 75 of each tray. Damage to the trays due to engagement by the spikes during storage and during removal for further use is minimized by the metal grommets 76.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A tray for the field drying of fruit comprising a substantially planar rectangular sheet of plastic material adapted to receive fruit to be dried thereon when the tray is disposed on the ground, said tray having substantially parallel side edges, being longitudinally corrugated, to resist longitudinal flexibility and transversely foldable over fruit received thereon to form a roll encapsulating the fruit, said edges being fitted for releasable latched engagement when the tray is transversely folded to maintain the tray in said rolled configuration, substantially coextensively with the length of the sheet.

2. The tray of claim 1 in which said sheet has a longitudinal edge curved from the plane of the sheet to form a hook and an opposite longitudinal edge engageable by the hook releasably to retain the tray in rolled condition.

3. The tray of claim 1 in which the corrugations have hills and valleys when the tray is disposed substantially flatly on the ground and the valleys are perforated to permit drainage of rain water therethrough.

4. The tray of claim 3 in which the sheet has tabs individual to the perforations in covering relation to their respective perforations when the portions of the tray in which they are disposed are inverted as in rolling for protection from the weather.

5. The tray of claim 1 in which one of the side edges is upwardly return bent and the opposite side edge is downwardly return bent for said releasable latched engagement when the tray is transversely folded.

6. A tray for the field drying of fruit adapted to receive fruit to be dried and to rest on uneven ground comprising:

A. a substantially planar sheet of flexible, resilient plastic material having predetermined longitudinal and transverse directions;

B. a longitudinally extending elongated valley formed in the sheet whereby the tray is relatively less flexible in the longitudinal direction to resist sagging when rested on the ground and relatively more flexible in the transverse direction to facilitate rolling the tray transversely from a planar condition to a rolled condition encapsulating fruit received on the tray;

C. the valley is upwardly open when the tray is in the planar condition and has a floor which is downwardly spaced from the plane of the sheet when the tray is in said condition;

D. the floor has a drainage perforation defined therein which extends downwardly therethrough when the tray is in its planar condition; and E. a tab mounted on the floor adjacent to the perforation, the tab extending in covering relation to said perforation when the tray is inverted as a portion thereof is when the tray is in the rolled condition.

7. The tray of claim 6 wherein:

A. the sheet is substantially rectangular, having a central portion provided with said valley and a pair of longitudinally extending edges disposed transversely oppositely of said portion;

B. one of said edges is extended downwardly from the central portion when the tray is in the unrolled condition and is curved toward said portion defining a convex surface of the edge disposed away from said portion; and C. the other of said edges is extended upwardly from the central portion when the tray is in the unrolled condition and is curved toward said portion defining a concave surface disposed toward said portion and engageable in releasable hooking relation with the concave surface when the tray is in the rolled condition so as to retain the tray in said condition.

8. The tray of claim 6 wherein:

A. the perforation has a pair of transversely opposite sides; and

B. the tab extends downwardly from one of said sides when the tray is in the unrolled condition and toward the other of said sides to a distal end downwardly spaced from said one side when the tray is in said condition, defining a transversely facing opening between said distal end and said other side, whereby the perforation is screened from access in a downward direction toward said floor when the tray is in the rolled condition and the floor is upwardly disposed.

9. The tray of claim 8 wherein:

A. said central portion has a pair of interconnected sections extended in transversely opposite directions from the transverse midline of said portion;

B. each of said sections has at least one of said valleys and each valley is provided with at least one of said perforations, each perforation having a respective one of said tabs defining a respective one of said transversely facing openings; and C. the openings in each of said sections face transversely away from the other of said sections.

10. The tray of claim 6 wherein:

A. the sheet is substantially rectangular, has a pair of longitudinally opposite edges, is provided with a plurality of said valleys, the floors of the valleys being disposed substantially the same distance downwardly from the plane of the sheet when the tray is in the unrolled condition;

B. the valleys have individual, longitudinally open, longitudinal ends disposed at one of said edges and have individual, longitudinally opposite, longitudinally closed ends spaced toward said one edge from the other of said edges; and C. the tray includes a plurality of projections spaced in a transversely extending row between said closed ends of the valleys and the other of said edges, the projections being formed in the sheet and extending downwardly from the plane thereof when the tray is in the unrolled condition to individual tips disposed downwardly of said plane a substantially greater distance than said floors are disposed whereby, when the tray is rested on the ground supported on said distal ends and said floors, the tips of the valleys are elevated above the open ends thereof to facilitate the drainage of rain water longitudinally along the valleys.

11. The tray of claim 10 wherein the projections are upwardly open when the tray is in the unrolled condition and are provided with individual perforations extended through their tips to permit drainage of rain water therethrough when the tip is downwardly disposed from the plane of the sheet as in said condition.

* * * * *